US011371775B2

(12) United States Patent
Chambron et al.

(10) Patent No.: US 11,371,775 B2
(45) Date of Patent: Jun. 28, 2022

(54) METHOD AND APPARATUS TO AVOID LNG FLASH WHEN EXPANDING TO THE LNG STORAGE FACILITY

(71) Applicant: L'Air Liquide, Societe Anonyme pour l'Etude et l'Exploitation des Procedes Georges Claude, Paris (FR)

(72) Inventors: Nicolas Chambron, Saint Maur des Fosses (FR); Loic Joly, Paris (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 1198 days.

(21) Appl. No.: 15/431,177

(22) Filed: Feb. 13, 2017

(65) Prior Publication Data

US 2017/0241705 A1 Aug. 24, 2017

(30) Foreign Application Priority Data

Feb. 18, 2016 (FR) ..... FR1 651 331

(51) Int. Cl.
*F25J 1/00* (2006.01)
*F25J 1/02* (2006.01)

(52) U.S. Cl.
CPC ..... *F25J 1/0057* (2013.01); *F25J 1/0022* (2013.01); *F25J 1/0052* (2013.01); *F25J 1/0072* (2013.01); *F25J 1/0204* (2013.01); *F25J 1/0254* (2013.01); *F25J 1/0262* (2013.01); *F25J 2240/12* (2013.01); *F25J 2290/34* (2013.01); *F25J 2290/62* (2013.01)

(58) Field of Classification Search
CPC ..... F25J 1/0022; F25J 1/0057; F25J 1/0072
USPC ..... 62/614
See application file for complete search history.

(56) References Cited

U.S. PATENT DOCUMENTS 6,272,882 B1 * 8/2001 Hodges ..... F25J 1/0022 62/613
2007/0256450 A1 11/2007 Mostello
2010/0186445 A1 * 7/2010 Minta ..... F25J 1/0022 62/606
2011/0209498 A1 * 9/2011 Bauer ..... F25J 3/0209 62/619

(Continued)

FOREIGN PATENT DOCUMENTS

DE 10 2013 001970 8/2014

OTHER PUBLICATIONS

HVAC Know It All, Adaptive Vs Fixed Expansion Valves, Dec. 20, 2019, Full Document (Year: 2019).*

(Continued)

*Primary Examiner* — Elizabeth J Martin
*Assistant Examiner* — Nael N Babaa
(74) *Attorney, Agent, or Firm* — Justin K. Murray

(57) ABSTRACT

Process for eliminating the evaporation of a liquefied natural gas stream during the transfer thereof into a storage facility, comprising the following steps:

Step a): liquefaction, by means of a refrigeration cycle, of a natural gas stream and of a nitrogen stream in a main heat exchanger;

Step b): cooling of the liquefied natural gas stream from step a) in a second heat exchanger by circulation of said liquefied natural gas stream countercurrent to a liquid nitrogen flow that is vaporized while cooling said liquefied natural gas stream;

wherein the liquid nitrogen flow used in step b) is from step a).

6 Claims, 1 Drawing Sheet

(56) References Cited

U.S. PATENT DOCUMENTS

2014/0238035 A1* 8/2014 Knapp ..... F23N 1/002
60/772

OTHER PUBLICATIONS

French Search Report and Written Opinion for FR 1 651 331, dated Nov. 7, 2016.

* cited by examiner

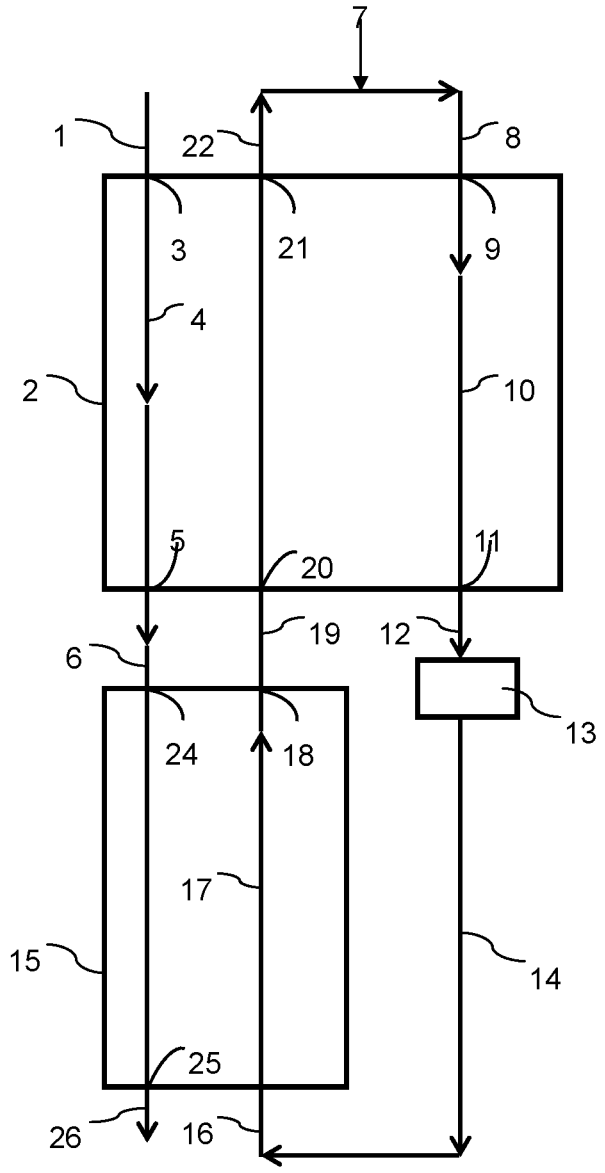
7
1
22
8
3
21
9
4
2
10
5
20
11
19
12
6
13
24
18
17
15
14
25
26
16

METHOD AND APPARATUS TO AVOID LNG FLASH WHEN EXPANDING TO THE LNG STORAGE FACILITY

CROSS REFERENCE TO RELATED APPLICATIONS

This application claims the benefit of priority under 35 § 119 (a) and (b) to French patent application No. FR 1651331, filed Feb. 18, 2016 the entire contents of which are incorporated herein by reference.

FIELD OF THE INVENTION

The present invention relates to a process for eliminating the evaporation of a stream of liquefied natural gas during the transfer thereof into a storage facility.

Specifically, it is important to avoid the evaporation of the liquefied natural gas during the transfer thereof from the liquefaction unit to the storage facility; liquefied natural gas being able to evaporate more or less easily during the transfer thereof depending on the temperature but also on the nitrogen content thereof.

BACKGROUND

In typical natural gas liquefaction plants using a mixed refrigerant cycle, refrigerant streams are used to produce cold at various levels of a main heat exchanger by vaporizing against the stream of hydrocarbons to be liquefied (typically natural gas). The mixed refrigerant is typically a mixture containing hydrocarbons. The refrigerant stream may equally well be a nitrogen stream.

It is desirable to liquefy natural gas for a certain number of reasons. By way of example, natural gas may be stored and transported over long distances more easily in the liquid state than in gaseous form, since it occupies a much smaller volume for a given mass and does not need to be stored at a high pressure.

Several methods are known for liquefying a stream of natural gas in order to obtain liquefied natural gas (LNG).

It is known to carry out the storage and transport of certain gases in a liquid form at very low temperature (typically below −160° C.) and at a pressure close to atmospheric pressure. However, the tanks in which these liquefied gases are stored and transported cannot be completely and perfectly insulated; therefore they suffer from heat losses.

The result of this is an evaporation of the liquid which will give rise to excess pressure in the tanks which, by rapidly becoming unacceptable, will require an evacuation of the evaporated gas.

Various solutions to this evaporation problem have therefore had to be envisaged, in particular during the transport of this liquefied gas. Thus, on the LNG carriers equipped with steam propulsion, the boil-off gas is evacuated from the storage tanks, reheated and burnt in boilers that directly feed a steam circuit that will drive the propeller of the carrier via a suitable reduction gear.

Unfortunately, steam propulsion is tending to disappear today and it is increasingly being replaced by methods of propulsion that are more energy efficient, such as diesel propulsion. Also, various projects exist that aim to treat the boil-off gases independently of the propulsion of the carrier by devices that tend to eliminate these evaporations by other means.

For example, it is known to reliquefy the boil-off gases and to then reinject them into the tank from which they came. However, this method implies the use of a reliquefaction unit that is even more complex and expensive since the liquefied gases stored and transported are not generally pure and since their vapours contain non-condensable components that should be the subject of a specific treatment and of a purge to the atmosphere which presents drawbacks from the point of view of safety and environmental protection.

The content of nitrogen in the natural gas is the key parameter for defining, at the pressure of the storage unit, the equilibrium temperature necessary, that is to say the temperature to be achieved in order to avoid the evaporation of the liquefied natural gas.

When the nitrogen content is high, the equilibrium temperature of the liquefied natural gas, at a given pressure, will be lower.

The table below illustrates the equilibrium temperature level required as a function of the nitrogen content of the stream of liquefied natural gas.

| Content of nitrogen in the natural gas (% by volume) | Equilibrium temperature at atmospheric pressure (° C.) |
|---|---|
| 0 | −161.3 |
| 5 | −172.5 |
| 10 | −179.2 |
| 15 | −183.1 |

If the equilibrium temperature is not reached by subcooling the liquefied natural gas, an evaporation of the latter will occur and will result in a significant loss of natural gas and therefore of energy.

Another aspect of the problem to be solved lies in the variation of the nitrogen content of the natural gas over time. For broad nitrogen content ranges, various equilibrium temperatures should be adjusted in order to avoid evaporation of the natural gas. This may lead to disturbances of the parameters of the process used in the natural gas liquefaction unit giving rise to a loss of efficiency or even operational impossibility.

SUMMARY OF THE INVENTION

The inventors of the present invention have then developed a solution that makes it possible to solve the problems raised above while optimizing the energy expenditure.

Certain embodiments of the present invention are drawn to a process for eliminating the evaporation of a liquefied natural gas stream during the transfer thereof into a storage facility, comprising the following steps:

step a): liquefaction, by means of a refrigeration cycle, of a natural gas stream and of a nitrogen stream in a main heat exchanger;

step b): cooling of the liquefied natural gas stream from step a) in a second heat exchanger by circulation of said liquefied natural gas stream countercurrent to a liquid nitrogen flow that is vaporized while cooling said liquefied natural gas stream;

wherein the liquid nitrogen flow used in step b) is from step a).

According to other embodiments, the present invention relates to:

A process as described above, characterized in that the nitrogen stream from step b) supplies the refrigeration cycle used in step a), after having cooled the liquefied natural gas stream, by being introduced at the coldest level of said main heat exchanger, then by circulating countercurrent to the streams to be liquefied during step a) up to the hottest level of said main heat exchanger where said nitrogen stream is vaporized.

A process as described above, characterized in that at least one portion of said vaporized nitrogen stream forms the nitrogen stream to be liquefied in the main exchanger used in step a).

A process as described above, comprising step c): expansion of the liquid nitrogen stream from step a) after leaving the main exchanger at its coldest level then introduction of said thus expanded stream into the second heat exchanger during step b).

A process as described above, characterized in that the liquid nitrogen stream from step a) is subcooled in the second heat exchanger before step c).

A process as described above, characterized in that the refrigeration cycle is a Turbo-Brayton nitrogen cycle.

A process as described above, characterized in that the natural gas introduced in step a) comprises at least 50% by volume of methane.

A process as described above, characterized in that the cooled liquefied natural gas from step b) is transferred to a storage facility.

A process as described above, characterized in that the parameters of the refrigeration cycle are adjusted during the process as a function of the temperature desired for the liquefied natural gas stream from step b) and as a function of the composition of said natural gas stream.

A process as described above, characterized in that the parameters of the refrigeration cycle are adjusted during the process as a function of the nitrogen content of said natural gas stream.

A process as described above, characterized in that the natural gas stream to be liquefied is introduced during step a) at the hottest level of the main heat exchanger and is discharged in liquid form at the coldest level of said main exchanger, then is introduced during step b) at the hottest level of the second heat exchanger and is then discharged at the coldest level of said second heat exchanger.

Although the process according to certain embodiments of the present invention is applicable to various hydrocarbon feed streams, it is particularly suitable for natural gas streams to be liquefied. In addition, a person skilled in the art will easily understand that, after liquefaction, the liquefied natural gas may be further treated, if desired.

The hydrocarbon stream to be liquefied is generally a natural gas flow obtained from natural gas or petroleum reservoirs.

Alternatively, the natural gas flow may also be obtained from another source, also including a synthetic source such as a Fischer-Tropsch process.

Customarily, the natural gas flow is essentially composed of methane. Preferably, the feed stream comprises at least 60 mol % of methane, preferably at least 80 mol % of methane.

Depending on the source, the natural gas may contain quantities of hydrocarbons heavier than methane, such as ethane, propane, butane and pentane and also certain aromatic hydrocarbons. The natural gas flow may also contain non-hydrocarbon products such as $H_2O$, $N_2$, $CO_2$, $H_2S$ and other sulphur-containing compounds, and other products.

The feed flow containing the natural gas may be pretreated before being introduced into the main heat exchanger. This pretreatment may comprise the reduction and/or the elimination of undesirable components such as $CO_2$ and $H_2S$, or other steps such as precooling and/or pressurization. Given that these measures are well known to a person skilled in the art, they are not described in more detail here.

The expression "natural gas" as used in the present application relates to any composition containing hydrocarbons including at least methane. This includes a "crude" composition (prior to any treatment such as cleaning or washing), and also any composition that has been partially, substantially or completely treated for the reduction and/or elimination of one or more compounds, including, but without being limited thereto, sulphur, carbon dioxide, water and hydrocarbons having two or more carbon atoms. The separator may be any unit, column or arrangement suitable for separating the mixed refrigerant into a vapour refrigerant stream and a liquid refrigerant flow. Such separators are known in the prior art and are not described in detail here.

The heat exchanger targeted by certain embodiments of the invention is preferably a plate exchanger but may be any column, a unit or other arrangement suitable for allowing the passage of a certain number of flows, and thus allowing a direct or indirect heat exchange between one or more refrigerant fluid lines and one or more feed flows.

The solution proposed has the following advantages:

- avoids the evaporation of the liquefied natural gas during transfer to the storage unit;
- makes it possible to adjust the temperature of the liquefied natural gas as a function of the fluctuations in the nitrogen content without modifying the parameters of the natural gas liquefaction process.

For this, liquid nitrogen is used for subcooling the liquefied natural gas downstream of the liquefaction unit. Depending on the nitrogen content of the natural gas, the subcooling temperature necessary for avoiding the evaporation varies: the higher the nitrogen content, the lower the subcooling temperature.

The use of liquid nitrogen makes it possible to adjust the subcooling temperature as a function of the nitrogen content of the natural gas stream.

Certain embodiments of the present invention are particularly advantageous on a liquefaction unit based on a nitrogen-based refrigeration cycle (reverse Brayton cycle). As nitrogen is the refrigeration means for this type of refrigeration cycle, the nitrogen may be drawn off directly under pressure from the refrigeration circuit and then liquefied through the heat exchanger being used to liquefy the natural gas. After having been discharged through the coldest end of the main heat exchanger, the liquid nitrogen may be expanded at low pressure before being vaporized in a subcooler in order to subcool the liquefied natural gas. On leaving the main heat exchanger, the nitrogen stream is then mixed with nitrogen from the refrigeration cycle.

BRIEF DESCRIPTION OF THE DRAWINGS

The present invention will be well understood, and its advantages will also become apparent in the light of the following description, provided purely by way of non-limiting example with reference to the appended drawings, in which:

In the only FIGURE:

The FIGURE shows a diagram in accordance with an embodiment of the invention.

DETAILED DESCRIPTION OF THE INVENTION

The invention will be described in a more detailed manner by referring to the FIGURE which illustrates the diagram of one particular embodiment of an implementation of a process according to the invention.

In the FIGURE, a flow 1 of natural gas optionally previously pretreated (typically having undergone a separation from a portion of at least one of the following constituents: water, $CO_2$, methanol, sulphur-containing compounds) is introduced into a main heat exchanger 2 in order to be liquefied.

The FIGURE therefore shows a process for liquefaction of a feed flow 1. The feed stream 1 may be a pretreated natural gas stream, in which one or more substances, such as sulphur, carbon dioxide, water, are reduced so as to be compatible with cryogenic temperatures, as is known in the prior art.

Optionally, the feed stream 1 may have undergone one or more precooling steps as is known in the prior art. One or more of the precooling steps may comprise one or more refrigeration circuits. By way of example, a natural gas feed stream is generally treated starting from an initial temperature of 30° C.-50° C. Following one or more precooling steps, the temperature of the natural gas feed stream may be reduced to −30° C. to −70° C.

In the FIGURE, the heat exchanger 2 is preferably a brazed aluminium plate cryogenic heat exchanger. Cryogenic heat exchanges are known in the prior art and may have various arrangements of their feed flow(s) and refrigerant streams. In addition, such heat exchangers may also have one or more lines to enable the passage of other flows, such as refrigerant streams for other steps of a cooling process, for example in liquefaction processes. These other lines or flows are not represented in the FIGURE for greater simplicity.

The feed stream 1 enters the heat exchanger 2 via a feed inlet 3 and passes through the heat exchanger via the line 4, then is extracted from the exchanger at the outlet 5 in order to provide a liquefied hydrocarbon flow 6. When the liquefied stream 6 is liquefied natural gas, the temperature may be around −150° C. to −170° C. The liquefaction of the feed stream 1 is carried out by means of a refrigerant fluid circuit 7. In this refrigerant circuit 7 a refrigerant, preferably nitrogen, circulates.

The liquefied natural gas flow 6 is then introduced into a second heat exchanger 15 via the inlet 24 at the hottest level of this second heat exchanger 15 in order to be subcooled to a temperature T3 lower than T2. The thus subcooled natural gas stream 26 is discharged from the heat exchanger 15 via the outlet 25 located at the coldest end of the exchanger 15. Typically, T3 is lower than T2, that is to say lower than −160° C., which temperature makes it possible to avoid the evaporation of the then subcooled liquefied natural gas 26, at the outlet 25.

In the arrangement of the operation of the heat exchanger 2 represented in the FIGURE, a gaseous refrigerant nitrogen stream 8 is introduced into the main exchanger 2 at an inlet 9 at the temperature T1 (for example between 0° C. and 40° C.), then it passes through this inlet and is liquefied and subcooled along the line 10 through the heat exchanger 2, to the outlet 11 in order to produce a liquid nitrogen stream 12.

The temperature T2 of the outlet 11 is lower than the temperature of the inlet 9 of the heat exchanger 2. T2 is typically between −80° C. and −175° C., for example −170° C. As it passes through the line 10, the gaseous refrigerant stream 8 is liquefied.

Thus, the nitrogen stream 8 and the natural gas stream 1 are liquefied in the same main heat exchanger 2 by one and the same refrigeration cycle 7.

The refrigerant nitrogen stream 12 is then expanded in an expander 13 for example using a valve, so as to provide a refrigerant stream at reduced pressure 14. This refrigerant stream 14 is then introduced into the lower part of a second heat exchanger 15 through the inlet 16 (at the coldest end of the exchanger 15). The temperature T3 of the inlet 16 is lower than T2. The introduction of the stream 14 into the heat exchanger 15 via the inlet 16 is then such that the passage of this refrigerant stream 14 through a line 17 in the heat exchanger 15 takes place in an ascending manner up to an outlet 18 of the heat exchanger 15. The temperature of this outlet 18 is substantially equal to T2.

The refrigerant stream 19 recovered at the outlet 18 of the heat exchanger 15 is then introduced via an inlet 20 into the coldest part of the main heat exchanger 2 at a temperature substantially equal to the temperature of the outlet 11. The refrigerant nitrogen stream is then reheated through the main heat exchanger 2 up to the outlet 21 at the temperature T1.

A gaseous refrigerant nitrogen stream 22 circulates in the refrigeration circuit 7 downstream of the outlet 21 of the main heat exchanger 2 at ambient temperature (that is to say the temperature measured in the space where the device for implementation of the process that is the subject of the present invention is placed. This temperature is for example between −20° C. and 45° C.).

A temperature substantially equal to another temperature is understood to mean a temperature equal to within ±5° C.

The cooled liquefied natural gas 26 at the end of the process that is the subject of the present invention may then, for example, be transferred to a storage or transport device.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A process for eliminating the evaporation of a liquefied natural gas stream during the transfer thereof into a storage facility, the process comprising the steps of:

Step a): liquefying, by use of a refrigeration cycle, a natural gas stream and a nitrogen stream in a main heat exchanger;

Step b): subcooling the liquefied natural gas stream from step a) in a second heat exchanger to a subcooled temperature by circulation of said liquefied natural gas stream countercurrent to an expanded liquid nitrogen flow that is vaporized while cooling said liquefied natural gas stream; and Step c): expanding the liquid nitrogen stream from step a) after leaving the main heat exchanger and then introducing the expanded liquid nitrogen flow into the second heat exchanger during step b), wherein the liquid nitrogen flow used in step b) is from step a), wherein the process further comprises the steps of determining a nitrogen content of the natural gas stream prior to step a), and adjusting the subcooled temperature of the liquefied natural gas stream as a function of the nitrogen content of the natural gas stream.

2. The process according to claim 1, wherein at least one portion of said of vaporized nitrogen stream forms the nitrogen stream to be liquefied in the main heat exchanger used in step a).

3. The process according to claim 1, wherein the natural gas introduced in step a) comprises at least 50% by volume of methane.

4. The process according to claim 1, wherein the cooled liquefied natural gas from step b) is transferred to a storage facility.

5. The process according to claim 1, wherein the step of adjusting the subcooled temperature of the liquefied natural gas stream as a function of the nitrogen content of the natural gas stream comprises adjusting parameters of the refrigeration cycle.

6. The process according to claim 1, wherein the natural gas stream to be liquefied is introduced during step a) at a warm end of the main heat exchanger and is discharged in liquid form at a cold end of said main heat exchanger, then is introduced during step b) at a warm end of the second heat exchanger and is then discharged at a cold end of said second heat exchanger.

* * * * *